US005871214A

United States Patent [19]

Hummel

[11] Patent Number: 5,871,214

[45] Date of Patent: Feb. 16, 1999

[54] HOOK AND LOOP DECORATION GAME

[76] Inventor: Greg Hummel, 1642 Chetney Dr., West Covina, Calif. 91790

[21] Appl. No.: 985,419

[22] Filed: Dec. 4, 1997

[51] Int. Cl.[6] ..... A63B 67/00

[52] U.S. Cl. ..... 273/348.4

[58] Field of Search ..... 273/348.4, 348.3

[56] References Cited

U.S. PATENT DOCUMENTS

| | | | |
|---|---|---|---|
| D. 323,195 | 1/1992 | Gehlbach | D11/118 |
| 3,997,162 | 12/1976 | Scullin | 273/348.3 |
| 4,030,736 | 6/1977 | Petrusek | 273/348.3 |
| 4,113,251 | 9/1978 | Imes, Jr. | 273/348.4 |
| 5,071,098 | 12/1991 | Aldridge | 248/219.4 |
| 5,195,336 | 3/1993 | Mershon | 63/29.1 |
| 5,324,042 | 6/1994 | Demas | 273/348.4 |
| 5,344,155 | 9/1994 | Huang | 273/348.4 |
| 5,416,928 | 5/1995 | Koenig | 2/244 |
| 5,433,448 | 7/1995 | Raphael et al. | 273/241 |

*Primary Examiner*—William H. Grieb

[57] ABSTRACT

A new hook and loop decoration game for combining a game with decorations for holidays. The inventive device includes a game board comprising a base panel. The base panel has apertures therethrough. Each of the apertures has a grommet disposed therein. The base panel has a layer of felt secured to a front surface thereof. The layer of felt has a layer of hook and loop material secured to a front surface thereof. The layer of hook and loop material has indicia painted thereon. A plurality of throwing objects are provided with each having a cloth outer layer and a padded interior. The cloth outer layer has hook and loop patches disposed on front and rear surfaces thereof.

6 Claims, 2 Drawing Sheets

HOOK AND LOOP DECORATION GAME

BACKGROUND OF THE INVENTION

1. Field of the Invention

The present invention relates to target games and more particularly pertains to a new hook and loop decoration game for combining a game with decorations for holidays.

2. Description of the Prior Art

The use of target games is known in the prior art. More specifically, target games heretofore devised and utilized are known to consist basically of familiar, expected and obvious structural configurations, notwithstanding the myriad of designs encompassed by the crowded prior art which have been developed for the fulfillment of countless objectives and requirements.

Known prior art target games include U.S. Pat. No. 4,113,251 to Imes, Jr.; U.S. Pat. No. 5,195,336 to Mershon; U.S. Pat. No. Des. 323,195 to Gehlbach; U.S. Pat. No. 5,433,448 to Raphael et al.; U.S. Pat. No. 5,416,928 to Koenig; and U.S. Pat. No. 5,071,098 to Aldridge.

While these devices fulfill their respective, particular objectives and requirements, the aforementioned patents do not disclose a new hook and loop decoration game. The inventive device includes a game board comprising a base panel. The base panel has apertures therethrough. Each of the apertures has a grommet disposed therein. The base panel has a layer of felt secured to a front surface thereof. The layer of felt has a layer of hook and loop material secured to a front surface thereof. The layer of hook and loop material has indicia painted thereon. A plurality of throwing objects are provided with each having a cloth outer layer and a padded interior. The cloth outer layer has hook and loop patches disposed on front and rear surfaces thereof.

In these respects, the hook and loop decoration game according to the present invention substantially departs from the conventional concepts and designs of the prior art, and in so doing provides an apparatus primarily developed for the purpose of combining a game with decorations for holidays.

SUMMARY OF THE INVENTION

In view of the foregoing disadvantages inherent in the known types of target games now present in the prior art, the present invention provides a new hook and loop decoration game construction wherein the same can be utilized for combining a game with decorations for holidays.

The general purpose of the present invention, which will be described subsequently in greater detail, is to provide a new hook and loop decoration game apparatus and method which has many of the advantages of the target games mentioned heretofore and many novel features that result in a new hook and loop decoration game which is not anticipated, rendered obvious, suggested, or even implied by any of the prior art target games, either alone or in any combination thereof.

To attain this, the present invention generally comprises a game board comprising a base panel having a generally square configuration. The base panel has four apertures therethrough disposed inwardly of four corners thereof. Each of the apertures has a grommet disposed therein. The base panel has a layer of felt secured to a front surface thereof. The layer of felt has a layer of hook and loop material secured to a front surface thereof. The layer of hook and loop material has a spider web painted thereon. A plurality of throwing objects are provided with each having a cloth outer layer and a padded interior. The cloth outer layer has hook and loop patches disposed on front and rear surfaces thereof. The plurality of throwing objects include shapes of a spider, a scarecrow, a bat, a pumpkin and a ghost.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hook and loop decoration game apparatus and method which has many of the advantages of the target games mentioned heretofore and many novel features that result in a new hook and loop decoration game which is not anticipated, rendered obvious, suggested, or even implied by any of the prior art target games, either alone or in any combination thereof.

It is another object of the present invention to provide a new hook and loop decoration game which may be easily and efficiently manufactured and marketed.

It is a further object of the present invention to provide a new hook and loop decoration game which is of a durable and reliable construction.

An even further object of the present invention is to provide a new hook and loop decoration game which is susceptible of a low cost of manufacture with regard to both materials and labor, and which accordingly is then susceptible of low prices of sale to the consuming public, thereby making such hook and loop decoration game economically available to the buying public.

Still yet another object of the present invention is to provide a new hook and loop decoration game which provides in the apparatuses and methods of the prior art some of the advantages thereof, while simultaneously overcoming some of the disadvantages normally associated therewith.

Still another object of the present invention is to provide a new hook and loop decoration game for combining a game with decorations for holidays.

Yet another object of the present invention is to provide a new hook and loop decoration game which includes a game board comprising a base panel. The base panel has apertures therethrough. Each of the apertures has a grommet disposed therein. The base panel has a layer of felt secured to a front surface thereof. The layer of felt has a layer of hook and loop material secured to a front surface thereof. The layer of hook and loop material has indicia painted thereon. A plurality of throwing objects are provided with each having a cloth outer layer and a padded interior. The cloth outer layer has hook and loop patches disposed on front and rear surfaces thereof.

Still yet another object of the present invention is to provide a new hook and loop decoration game that is a festive game which would provide an eye-catching decoration.

Even still another object of the present invention is to provide a new hook and loop decoration game that provides an ornate addition to various locations within the home which could add to the holiday spirit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
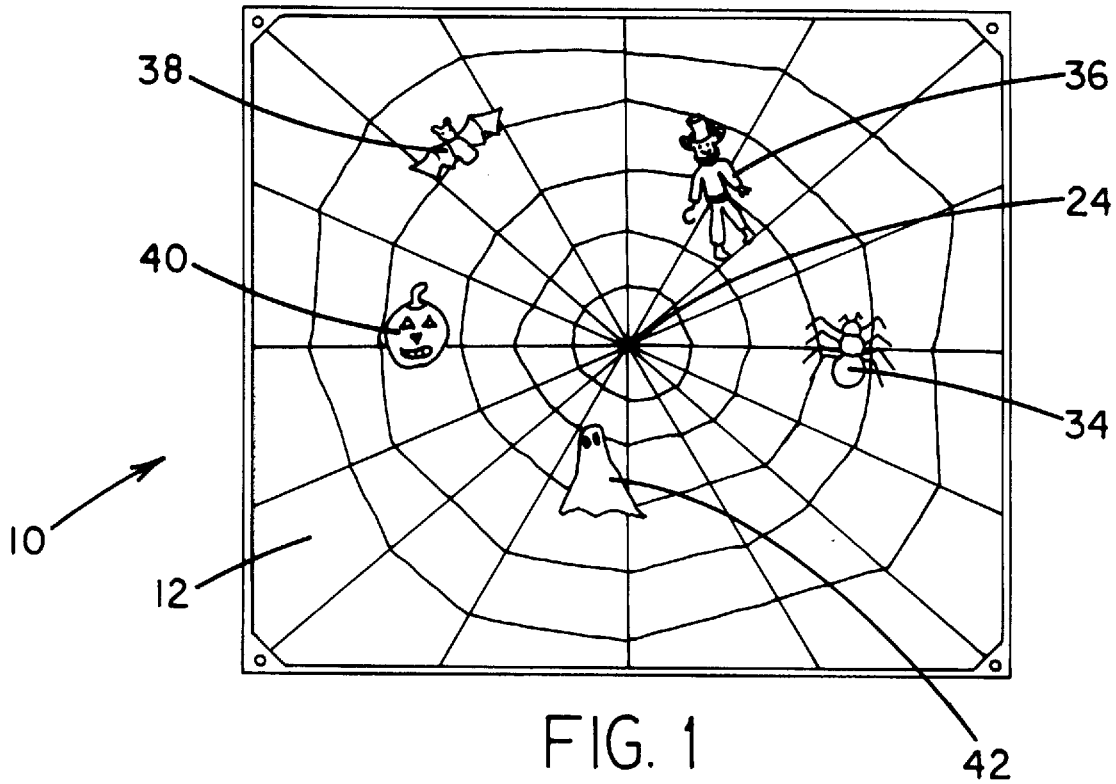
FIG. 1 is a front view of a new hook and loop decoration game according to the present invention.
Figure 2:
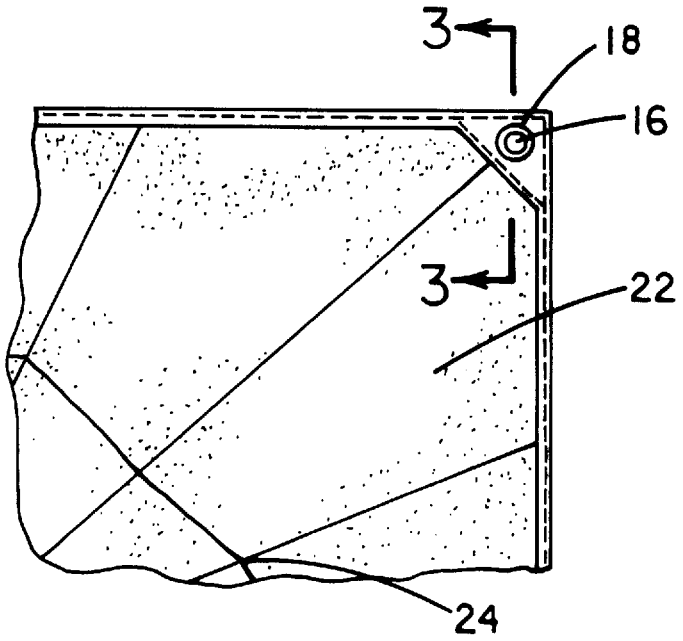
FIG. 2 is a sectional front view of the present invention.
Figure 3:
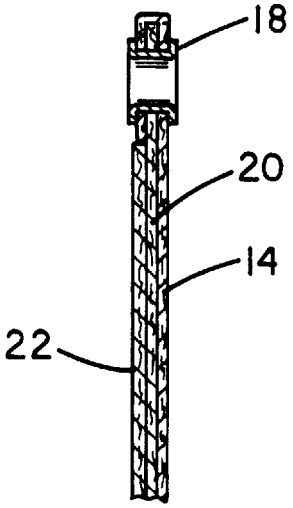
FIG. 3 is a cross-sectional view of the present invention as taken along line 3—3 of FIG. 2.
Figure 4:
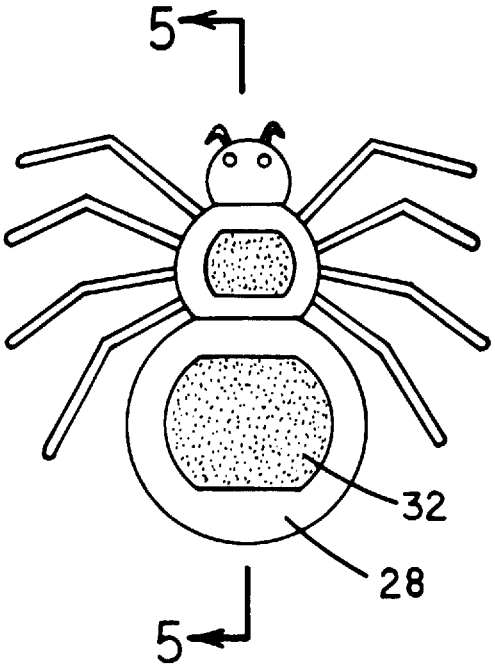
FIG. 4 is a front view of one of the throwing objects of the present invention.
Figure 5:
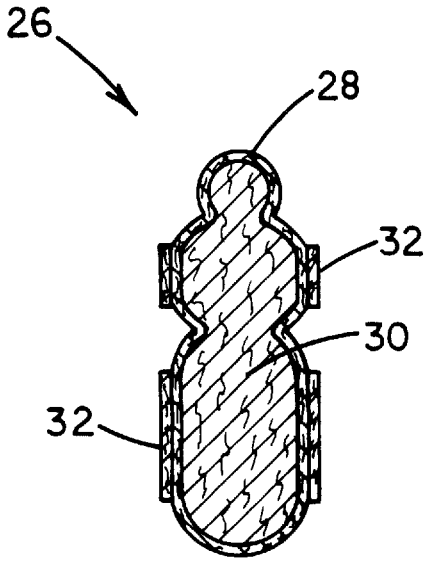
FIG. 5 is a cross-sectional view of the present invention as taken along line 5—5 of FIG. 4.
Figure 6:
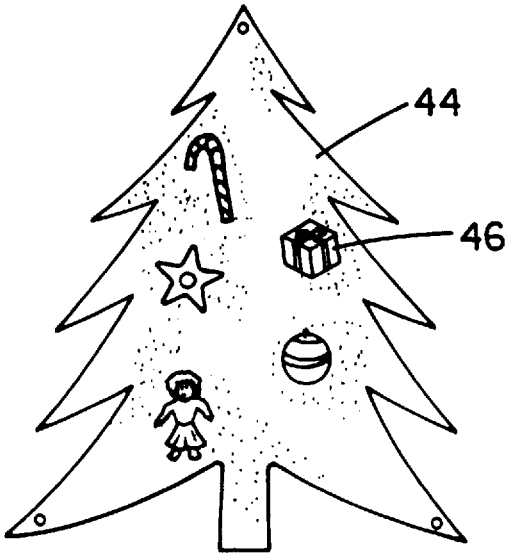
FIG. 6 is a front view of an alternate embodiment of the present invention.

With reference now to the drawings, and in particular to FIGS. 1 through 6 thereof, a new hook and loop decoration game embodying the principles and concepts of the present invention and generally designated by the reference numeral 10 will be described.

As best illustrated in FIGS. 1 through 6, the hook and loop decoration game 10 comprises a game board 12 comprising a base panel 14 having a generally square configuration. The base panel 14 has four apertures 16 therethrough disposed inwardly of four corners thereof. Each of the apertures 16 has a grommet 18 disposed therein. The base panel 14 has a layer of felt 20 secured to a front surface thereof. The layer of felt 20 has a layer of hook and loop material 22 secured to a front surface thereof. The layer of hook and loop material 22 has a spider web 24 painted thereon.

A plurality of throwing objects 26 are provided with each having a cloth outer layer 28 and a padded interior 30. The cloth outer layer 28 has hook and loop patches 32 disposed on front and rear surfaces thereof. The plurality of throwing objects 26 include shapes of a spider 34, a scarecrow 36, a bat 38, a pumpkin 40 and a ghost 42.

In use, the present invention is an entertaining holiday game which would also provide an eye-catching decoration. The present invention could be produced for a wide array of holidays including Halloween, Christmas, Thanksgiving, Chanukah, Easter, etc. The game board 12 could be produced in a wide array of holiday shapes including a Christmas tree 44, spider web, a table for Thanksgiving, a Star of David, etc. The throwing objects 26 would be produced in various holiday shapes corresponding with the game board 12. The Christmas tree 44 includes throwing objects shaped like ornaments 46. In order to play the game, the game board 12 is hung on the wall. Next, players would take turns ornamenting the holiday decoration by throwing the throwing objects 26. The objects 26 would adhere to the game board 12 through the inclusion of the hook and loop material. After play, the device 10 could remain upon the wall to provide a holiday decoration.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hook and loop decoration game kit for combining a game with decorations for holidays comprising, in combination:

a game board comprising a base panel having a generally square configuration, the base panel having four apertures therethrough disposed inwardly of four corners thereof, each of the apertures having a grommet disposed therein, the base panel having a layer of felt secured to a front surface thereof, the layer of felt having a layer of hook and loop material secured to a front surface thereof;

the layer of hook and loop material having a spider web marked thereon, the spider web having a plurality of straight lines being extended between opposite points on a peripheral edge of the layer of hook and loop material and through a central point of the layer of hook and loop material, wherein a vertical straight line is extended vertically between opposite points on the peripheral edge, wherein a horizontal straight line is extended horizontally between the central point and the peripheral edge of the layer of hook and loop material, a pair of perpendicular angled straight lines being extended from opposite points on the peripheral edge between opposite corners of the layer of hook and loop material, wherein a plurality of straight lines are extended between points on the peripheral edge being positioned midway between the ends of the angled straight lines and the horizontal line, a plurality of straight lines being extended between points on the peripheral edge being positioned midway between the ends of the angled straight lines and the vertical line, the spider web having at least four generally concentric lines;

a plurality of throwing objects each having a cloth outer layer and a padded interior, the cloth outer layers of each of the throwing objects having at least two hook and loop patches disposed on a front surface thereof, the cloth outer layer having at least two hook and loop patches disposed on a rear surface thereof, wherein the hook and loop patches are oblong having planar sides extending between opposite arcuate ends, the plurality of throwing objects including shapes of a spider, a scarecrow, a bat, a pumpkin and a ghost.

2. The hook and loop decoration game kit as set forth in claim 1 wherein the base panel has an outer periphery being extended over a front peripheral edge of the layer of felt, the outer periphery of the base panel having 45 degree bevels in corners thereof.

3. The hook and loop decoration game kit as set forth in claim 1 wherein the throwing object has the shape of a spider having a head portion, a middle portion, and a rear portion, the middle portion having a pair of sides and four legs extending from each of the sides, the middle portion having a hook and loop patch being disposed on front and rear surfaces thereof, the back portion having a hook and loop patch being disposed on front and rear surfaces thereof.

4. A hook and loop decoration game kit for combining a game with decorations for holidays comprising, in combination:

a game board comprising a base panel, the base panel having apertures therethrough, each of the apertures having a grommet disposed therein, the base panel having a layer of felt secured to a front surface thereof, the layer of felt having a layer of hook and loop material secured to a front surface thereof, the layer of hook and loop material having spider web indicia marked thereon, the spider web having a plurality of straight lines being extended between opposite points on a peripheral edge of the layer of hook and loop material and through a central point of the layer of hook and loop material, wherein a vertical straight line is extended vertically between opposite points on the peripheral edge, wherein a horizontal straight line is extended horizontally between the central point and the peripheral edge of the layer of hook and loop material, a pair of perpendicular angled straight lines being extended from opposite points on the peripheral edge between opposite corners of the layer of hook and loop material, wherein a plurality of straight lines are extended between points on the peripheral edge being positioned midway between the ends of the angled straight lines and the horizontal line, a plurality of straight lines being extended between points on the peripheral edge being positioned midway between the ends of the angled straight lines and the vertical line, the spider web having at least four generally concentric lines; and a plurality of throwing objects each having a cloth outer layer and a padded interior, the cloth outer layer having hook and loop patches disposed on front and rear surfaces thereof.

5. The hook and loop decoration game kit as set forth in claim 4 wherein each of the cloth outer layers of the throwing objects has at least two hook and loop patches disposed on a front surface thereof, the cloth outer layer having at least two hook and loop patches disposed on a rear surface thereof.

6. A hook and loop decoration game kit for combining a game with decorations for holidays comprising, in combination:

a game board comprising a base panel, the base panel being shaped in the form of a Christmas tree, the base panel having an upper tip, a lower trunk portion, and two sides, each of the sides having at least four points resembling branches of a tree, the upper tip having an aperture therethrough, the points of the sides being positioned closest the trunk portion having an aperture therethrough, each of the apertures having a grommet disposed therein;

the base panel having a layer of felt secured to a front surface thereof, the layer of felt having a layer of hook and loop material secured to a front surface thereof; and a plurality of throwing objects each having a cloth outer layer and a padded interior, the cloth outer layer having hook and loop patches disposed on front and rear surfaces thereof, the plurality of throwing objects including shapes of a candy cane, a star, a doll, a gift and a Christmas ball.

* * * * *